US006527654B2

(12) United States Patent
Sajima

(10) Patent No.: US 6,527,654 B2
(45) Date of Patent: Mar. 4, 2003

(54) GOLF BALL

(75) Inventor: Takahiro Sajima, Kobe (JP)

(73) Assignee: Sumitomo Rubber Industries, Ltd., Kobe (KP)

( * ) Notice: Subject to any disclaimer, the term of this patent is extended or adjusted under 35 U.S.C. 154(b) by 0 days.

(21) Appl. No.: 09/978,065

(22) Filed: Oct. 17, 2001

(65) Prior Publication Data

US 2002/0077198 A1 Jun. 20, 2002

(30) Foreign Application Priority Data

Oct. 27, 2000 (JP) ..... 2000-328292

(51) Int. Cl.[7] ..... A63B 37/14
(52) U.S. Cl. ..... 473/383; 473/384
(58) Field of Search ..... 473/378–384

(56) References Cited

U.S. PATENT DOCUMENTS 4,869,512 A * 9/1989 Nomura et al. ..... 473/383
5,143,377 A * 9/1992 Oka et al. ..... 473/383
5,377,989 A * 1/1995 Machin ..... 473/379
5,890,975 A 4/1999 Stiefel
6,231,463 B1 * 5/2001 Tavares et al. ..... 473/378
6,277,038 B1 * 8/2001 Suillivan ..... 473/383

FOREIGN PATENT DOCUMENTS

JP 2000-185113 7/2000

* cited by examiner

*Primary Examiner*—Steven Wong
*Assistant Examiner*—Raeann Gorden
(74) *Attorney, Agent, or Firm*—Birch, Stewart, Kolasch & Birch, LLP

(57) ABSTRACT

A golf ball has four kinds of dimples A to D. The A and B dimples are teardrop-shaped to take specific shapes. The C and D dimples are circular. A ratio of non-circular dimples is 77% to 92%. A ratio of the circular dimples is 8% to 23%. A ratio of the total number of the dimples taking specific shapes to all the non-circular dimples is 80% or more. When the number of dimples of such a kind as to have a minimum length of a contour line is represented by Ns and the number of dimples of such a kind as to have a maximum length of a contour line is represented by Nb in all kinds of dimples taking specific shapes, a ratio of (Ns/Nb) is 20/80 to 80/20. A dimple pattern in a hemisphere is rotation symmetrical at an angle of 120 degrees or 90 degrees. The golf ball comprises a specific land portion Ls.

5 Claims, 15 Drawing Sheets

(a)

(b)

(a)

(b)

GOLF BALL

BACKGROUND OF THE INVENTION

1. Field of the Invention

The present invention relates to a golf ball and more particularly to an improvement in a dimple of the golf ball.

2. Description of the Related Art

A golf ball has approximately 300 to 550 dimples on a surface thereof. The role of the dimples resides in one aspect that such dimples disturb an air stream around the golf ball during the flight of the golf ball to accelerate the transition of a turbulent flow over a boundary layer, thereby causing a turbulent flow separation (which will be hereinafter referred to as a "dimple effect"). The acceleration of the transition of the turbulent flow causes a separating point of air from the golf ball to be shifted backwards so that a pressure resistance is reduced, resulting in an increase in a flight distance of the golf ball. Moreover, the acceleration of the transition of the turbulent flow increases a distance between upper and lower separating points of the golf ball which is generated by a backspin. Consequently, a lift acting on the golf ball is increased. A dimple capable of easily accelerating the transition of the turbulent flow, that is, a dimple capable of better disturbing an air stream is more excellent in an aerodynamic characteristic.

In order to enhance the aerodynamic characteristic, there have been various proposals for the shape of a dimple. U.S. Pat. No. 5,890,975 has disclosed a golf ball having an elongated dimple. Moreover, Japanese Unexamined Patent Publication No. 2000-185113 has disclosed a golf ball having a dimple taking an elliptic planar shape (the contour shape of the dimple seen in the direction of a normal), a golf ball having a dimple taking an oval planar shape, and a golf ball having a dimple taking a planar shape of a teardrop.

A golf player is very interested in making a good score and causing a golf ball to fly to a distance. A large number of golf players desire a golf ball which is more excellent in flight performance. However, the golf ball to meet the demand of the golf player has not been obtained.

In consideration of the circumstances, it is an object of the present invention to provide a golf ball which is excellent in flight performance.

SUMMARY OF THE INVENTION

In order to attain the above-mentioned object, the invention provides a golf ball having, on a surface thereof, a large number of non-circular dimples taking planar shapes other than a circle and a large number of circular dimples taking circular planar shapes, wherein a ratio of the number of the non-circular dimples to the number of all dimples is 77% to 92%, a ratio of the number of the circular dimples to the number of all the dimples is 8% to 23%, the non-circular dimples include plural kinds of dimples taking specific shapes, a ratio of the total number of the dimples taking specific shapes to all the non-circular dimples is 80% or more, when the number of a certain kind of dimples which contour line length is minimum in kinds having a specific shape and a dimple number ratio of 5% or more is represented by Ns and the number of a certain kind of dimples which contour line length is maximum in kinds having a specific shape and a dimple number ratio of 5% or more is represented by Nb, a ratio (Ns/Nb) is 20/80 to 80/20, and a dimple pattern is rotation symmetrical at an angle of 120 degrees or 90 degrees by setting a pole to be a center of rotation in both of two hemispheres obtained by a division through a parting surface of a mold.

The dimples taking specific shapes satisfy the following conditions (A) and (B):

(A) a contour line in a planar shape is formed by a combination of a semicircle and a circular arc or a combination of a semicircle and an elliptic arc; and (B) the contour line does not have a convex portion therein.

In the golf ball, the multiplied effects of the dimple taking the specific shape and the circular dimple can enhance an aerodynamic characteristic. The golf ball is excellent in flight performance.

It is preferable that the dimple pattern should not be mirror symmetrical in both of the two hemispheres obtained by the division through the parting surface of the mold. In other words, even if the hemisphere is further divided into two portions on any plane to be a quarter sphere, the dimple patterns of two quarter spheres are not symmetrical with respect to the plane. Consequently, the dimple effect can further be enhanced.

It is preferable that the surface of the golf ball should be provided with twelve or more specific land portions surrounded by five dimples taking a specific shape which are arranged at a substantially equal center angle pitch. By the specific land portion, the disturbance of the air is further promoted.

It is preferable that the specific land portion should be provided uniformly on a surface. Consequently, almost equivalent dimple effects can be obtained irrespective of the position of a portion where the circumferential speed of a backspin is the highest (which will be hereinafter referred to as "the highest speed portion").

It is preferable that a sum of volumes of dimples (in a portion surrounded by a virtual sphere of the ball and surfaces of the dimples) is 400 $mm^3$to 550 $mm^3$. Consequently, it is possible to obtain more excellent flight performance.

The present invention will be described below in detail based on preferred embodiments with reference to the drawings.

DESCRIPTION OF THE PREFERRED EMBODIMENTS

Figure 1:
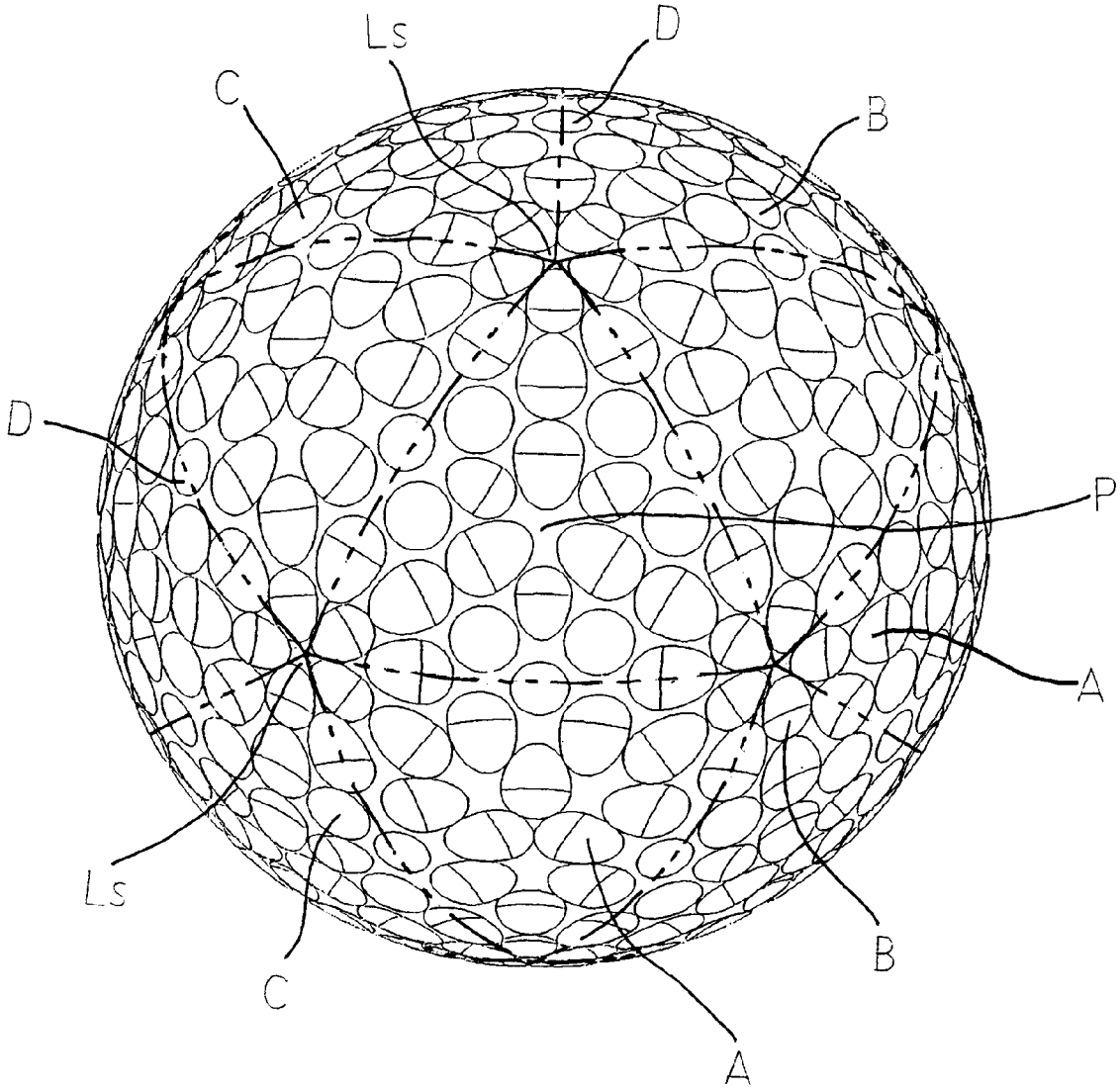
FIG. 1 is a plan view showing a golf ball according to an embodiment of the present invention.
Figure 2:
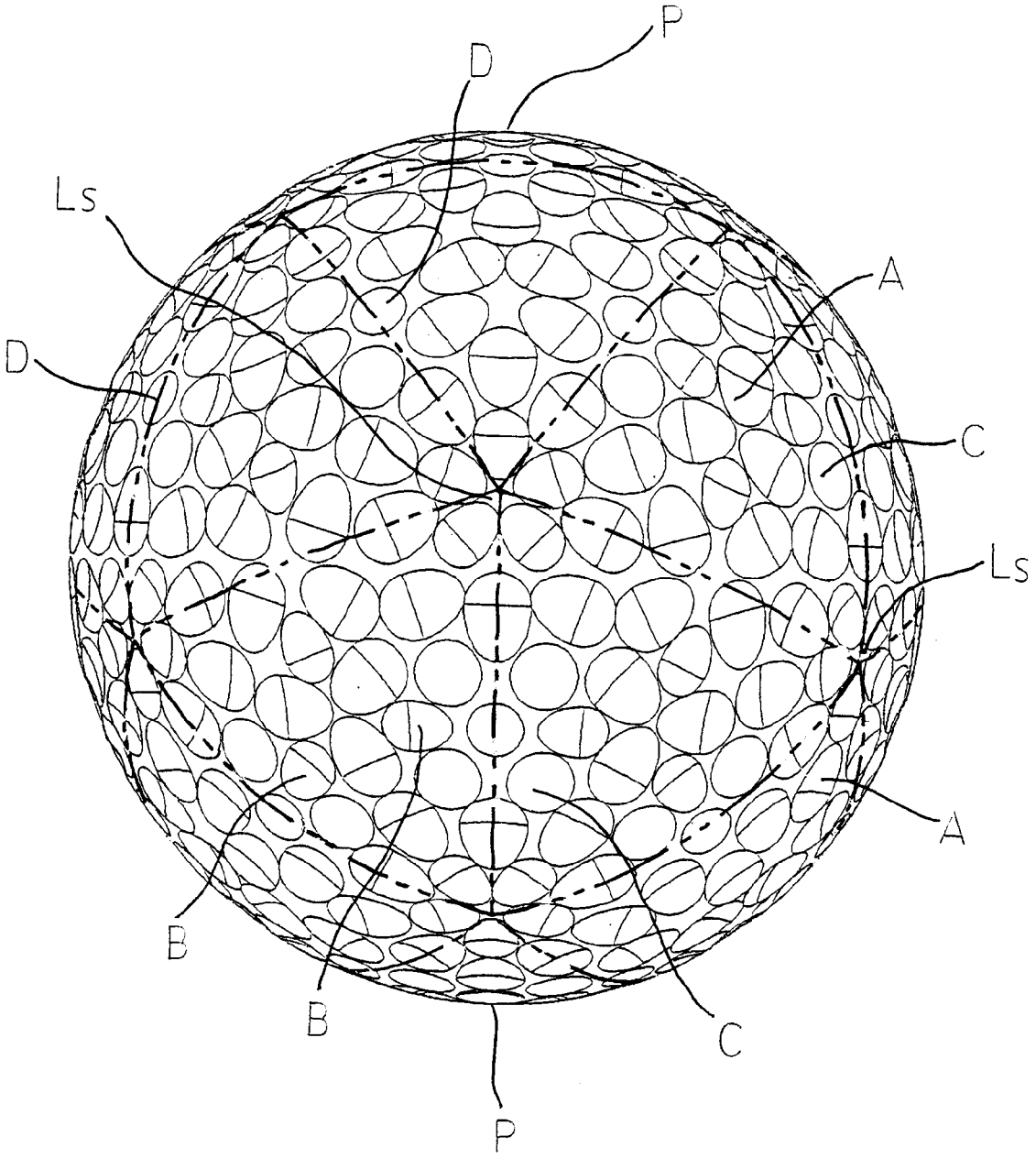
FIG. 2 is a front view showing the golf ball in FIG. 1, FIG. 3(*a*) is a plan view showing a teardrop-shaped dimple, FIG. 3(*b*) is a sectional view showing the teardrop-shaped dimple in FIG. 3(*a*)

FIGS. 1 and 2 show a golf ball according to an embodiment of the present invention. In FIG. 2, a portion corresponding to a parting line of a mold including upper and lower parts having hemispherical cavities is positioned on a front part and is extended in a transverse direction. The golf ball usually has a diameter of approximately 42.67 mm to 43.00 mm. The golf ball has four kinds of dimples A to D. The A and B dimples are teardrop-shaped to take specific shapes.

Figure 3:
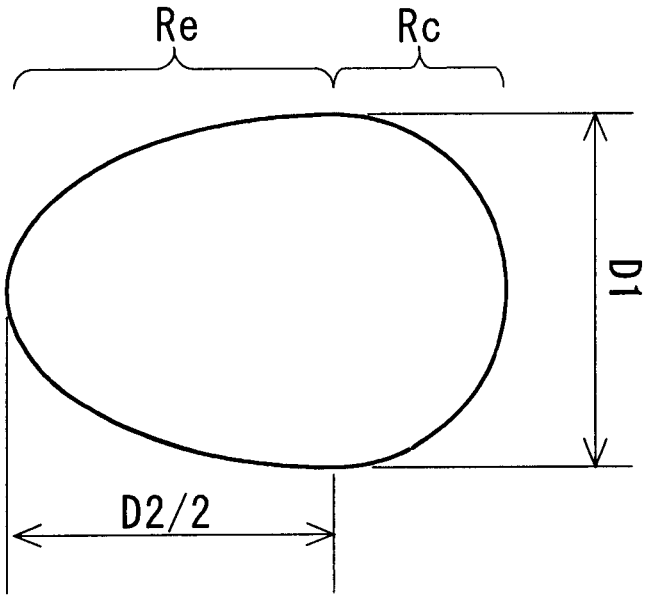
Figure 3:
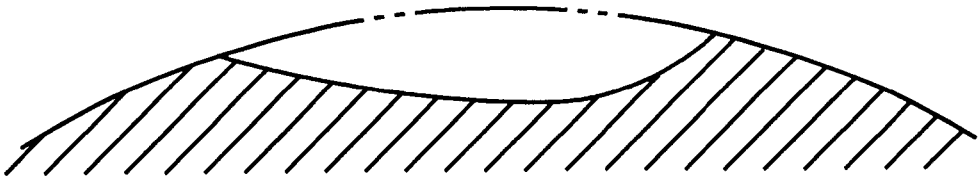

FIG. 3(*a*) is a plan view showing the teardrop-shaped dimple and FIG. 3(*b*) is a sectional view showing the teardrop-shaped dimple. The teardrop-shaped dimple has a planar contour constituted by a semicircular portion Rc and a semielliptic portion Re. The semicircular portion Rc is equivalent to a half of a circle having a diameter of D1. The semielliptic portion Re is equivalent to a half of an ellipse having a major axis of D2 and a minor axis of D1. The contour line of the teardrop-shaped dimple does not have a convex portion therein.

The teardrop-shaped dimple has a directivity and produces a greater effect of disturbing an air stream than the circular dimple. Accordingly, the teardrop-shaped dimple contributes to an enhancement in the flight distance of the golf ball. On the other hand, the dimple having the directivity might damage flight symmetry. However, the teardrop-shaped dimple has the semicircular portion Rc, and furthermore, portions other than the semicircular portion Rc are also smooth curves. Therefore, a bad influence on the flight symmetry can be suppressed.

The golf ball shown in FIGS. 1 and 2 have 240 A dimples, 102 B dimples, 60 C dimples and 24 D dimples. The total number of dimples is 426. The A dimple has a contour constituted by a semicircle having a diameter D1 of 3.40 mm and a semiellipse having a minor axis D1 of 3.40 mm and a major axis D2 of 5.60 mm (D2/2 of 2.80 mm in FIG. 3(*a*)). The B dimple has a contour constituted by a semicircle having a diameter D1 of 2.75 mm and a semiellipse having a minor axis D1 of 2.75 mm and a major axis D2 of 4.55 mm (D2/2 of 2.275 mm in FIG. 3(*a*)). The C dimple is a circle having a diameter of 3.40 mm. The D dimple is a circle having a diameter of 2.85 mm.

Preferably, the circular dimple has a diameter of 2.0 mm to 4.7 mm, and more preferably, 2.2 mm to 4.5 mm. If the diameter is less than the range, each dimple has a small area so that the dimple effect is obtained with difficulty. To the contrary, if the diameter is more than the range, the number of the dimples of the whole golf ball is small so that the dimple effect is obtained with difficulty.

The ratio of the number (342) of non-circular dimples to the number (426) of all the dimples is 80.3%. All the non-circular dimples are teardrop-shaped to take specific shapes. On the other hand, in the golf ball, the ratio of the number (84) of circular dimples to the number (426) of all the dimples is 19.7%. Thus, the non-circular dimples (particularly, the dimples taking specific shapes) and the circular dimples are present together so that the dimple effect of the whole golf ball can be enhanced.

The ratio of the number of the non-circular dimples to the number of all the dimples is set to 77% to 92% and the ratio of the number of the circular dimples to the number of all the dimples is set to 8% to 23%. In some cases in which the ratio of the non-circular dimples is less than the range (that is, the ratio of the circular dimples is more than the range), the effect of disturbing an air stream by the non-circular dimple becomes insufficient. In some cases in which the ratio of the non-circular dimples is more than the range (that is, the ratio of the circular dimples is less than the range), the effect of disturbing an air stream through the mixture of the non-circular dimples and the circular-dimples becomes insufficient. From these viewpoints, it is preferable that the ratio of the number of the non-circular dimples to the number of all the dimples should be 80% to 86% and the ratio of the number of the circular dimples to the number of all the dimples should be 14% to 20%.

The ratio of the total number of dimples taking specific shapes to the number of all the non-circular dimples (hereinafter referred to as "the ratio of the dimples taking specific shapes") should be set to 80% or more. If the ratio of the dimples taking specific shapes is less than 80%, the effect of the dimples taking specific shapes which does not adversely affect flight symmetry while maintaining the effect of disturbing an air stream is obtained for the whole golf ball with difficulty. From this viewpoint, the ratio of the dimples taking specific shapes is preferably 90% or more, more preferably 95% or more, and ideally 100%.

The dimples taking specific shapes include a dimple having a planar contour line formed by a combination of a semicircle and a circular arc and a dimple having a planar contour line formed by a combination of a semicircle and an elliptic arc (a part of an ellipse). The teardrop-shaped dimple shown in FIG. 3 is included in the dimples taking specific shapes having contour lines formed by the combination of a semicircle and an elliptic arc. The dimples taking specific shapes do not include the circular dimple having less effect of disturbing an air stream.

Figure 4:
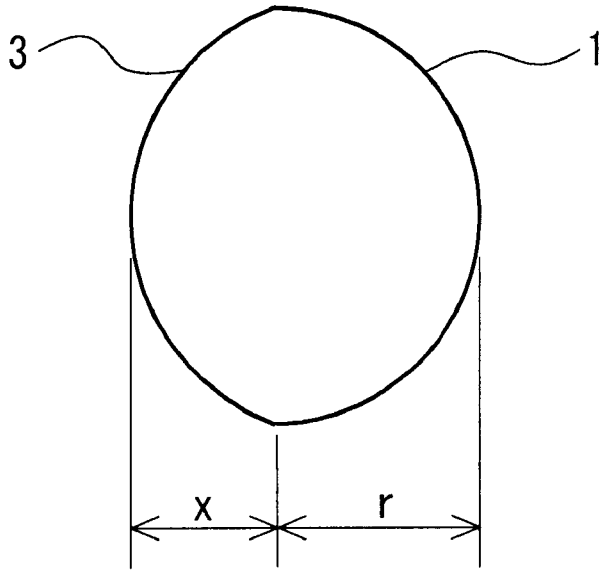
FIG. 4 is a plan view showing a dimple taking a specific shape.
Figure 4:
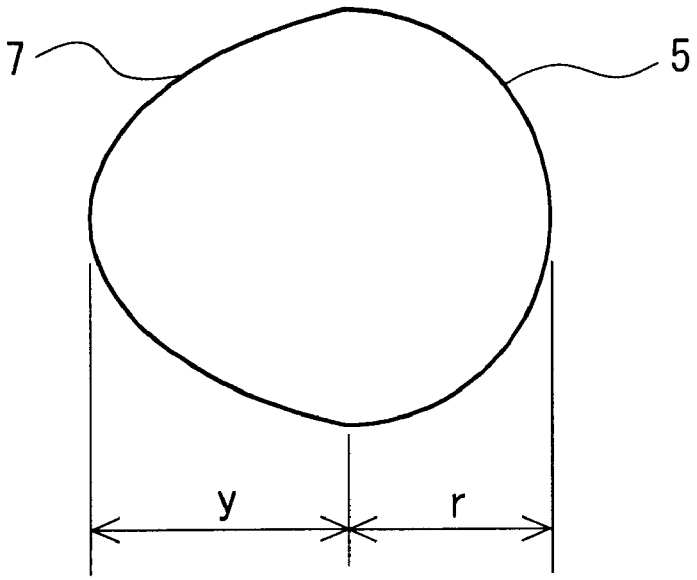

FIG. 4 is a plan view showing another dimple taking a specific shape. The dimple taking a specific shape shown in FIG. 4(*a*) has a contour line constituted by a semicircle 1 and a circular arc 3 of a circle having a larger diameter than the diameter of the semicircle 1. Moreover, the dimple taking a specific shape in FIG. 4(*b*) has a contour line constituted by a semicircle 5 and an elliptic arc 7 of an ellipse having a larger minor axis than the diameter of the semicircle 5. Since both of the dimples having specific shapes include the semicircles 1 and 5, any dimple having a directivity less affects the flight symmetry adversely.

It is preferable that the semicircles 1 and 5 in the dimples having specific shapes should have radii of 1 mm to 2.35 mm (which are shown in an arrow r of FIGS. 4(*a*) and 4(*b*)). In the dimple taking a specific shape having a contour line constituted by the semicircle 1 and the circular arc 3 shown in FIG. 4(*a*), it is preferable that the protrusion length (shown in an arrow x) of the circular arc 3 should satisfy the following equation (1).

$$r/2 \leqq x \leqq (9.5031\ r \times 3) \qquad \text{(I)}$$

Moreover, in the dimple taking a specific shape having a contour line constituted by the semicircle 5 and the elliptic arc 7 shown in FIG. 4(*b*), it is preferable that the protrusion length (shown in an arrow y) of the elliptic arc 7 should satisfy the following equation (II).

$$r/2 \leqq y \leqq r \quad \text{(II)}$$

If the radius r, the protrusion length x or the protrusion length y is less than the range, each dimple has a small area so that the dimple effect is obtained with difficulty. To the contrary, if the radius r, the protrusion length x or the protrusion length y is more than the range, the number of the dimples of the whole golf ball is reduced so that the dimple effect is obtained with difficulty.

Figure 5:
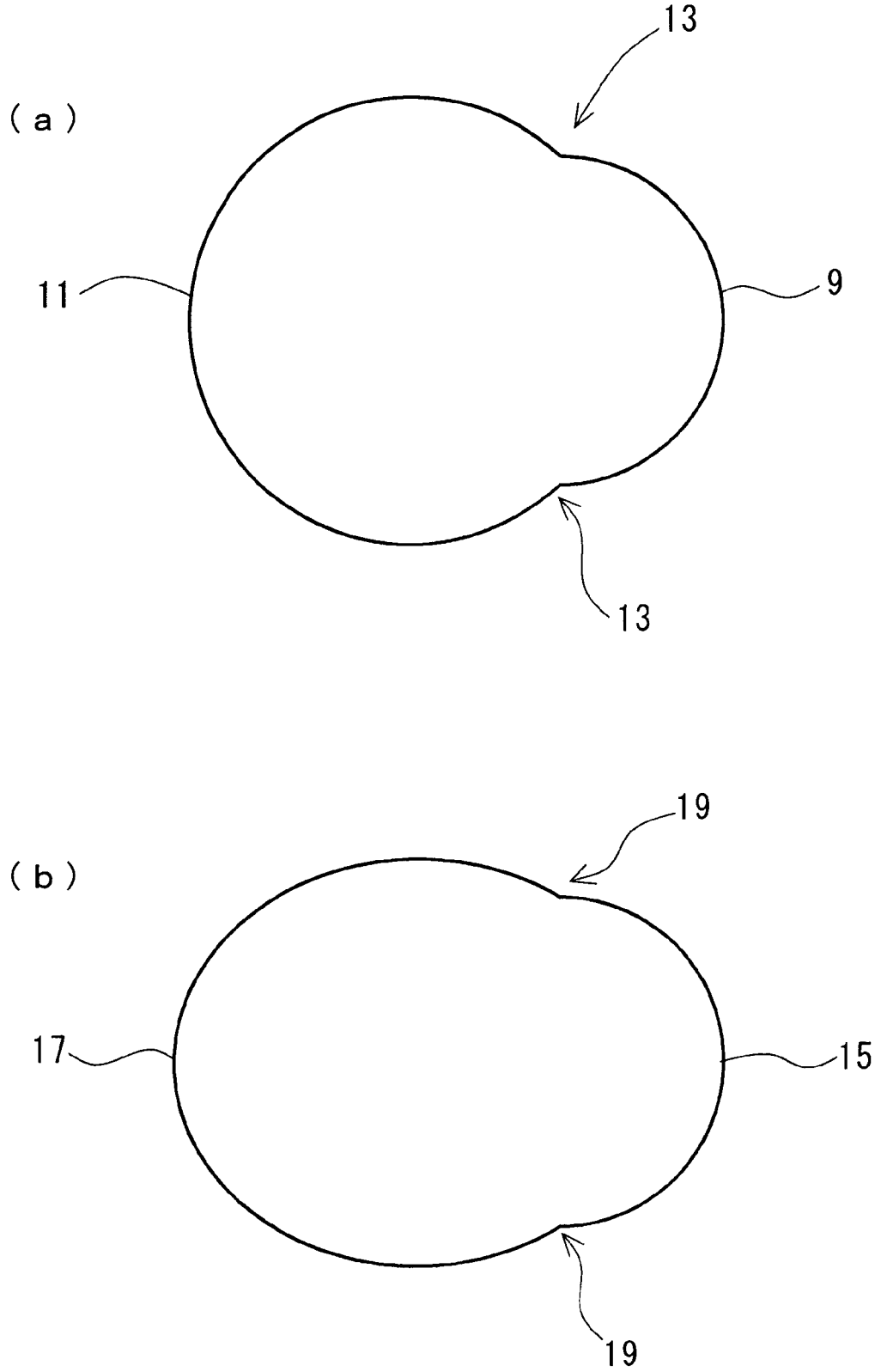
FIG. 5 is a plan view showing a non-circular dimple which does not take a specific shape.

FIG. 5 is a plan view showing a non-circular dimple which does not take a specific shape. A non-circular dimple shown in FIG. 5(*a*) is common to the dimple taking a specific shape in FIG. 4(*a*) in that it has a contour line constituted by a semicircle 9 and a circular arc 11 of a circle having a larger diameter than the diameter of the semicircle 9. However, since the non-circular dimple includes a convex portion 13 in two places therein, it can not be demnominated "a apecific shape". A non-circular dimple in FIG. 5(*b*) is common to the dimple taking a specific shape in FIG. 4(*b*) in that it has a contour line constituted by a semicircle 15 and an elliptic arc 17 of an ellipse having a larger minor axis than the diameter of the semicircle 15. However, since the non-circular dimple includes a convex portion 19 in two places therein, it can not denominated "a specific shape". Both of the non-circular dimples have directivities. Accordingly, a golf ball having a large number of these non-circular dimples formed thereon has poor flight symmetry.

The golf ball shown in FIGS. 1 and 2 has plural kinds of dimples taking specific shapes (two kinds of dimples A and B). By the mixture of plural kinds of dimples having specific shapes, the effect of disturbing an air stream is promoted. Dimples taking specific shapes which are analogous to each other and are not congruent and dimples taking specific shapes which are neither analogous nor congruent have different kinds from each other. In the teardrop-shaped dimple shown in FIGS. 1 and 2, a boundary line of a semicircular portion and a semielliptic portion is drawn. In the case in which both of them are continuously provided smoothly, the boundary line does not appear as an edge.

In this specification, a ratio of the number of dimples of a certain kind to the total number of dimples will be referred to as a "dimple number ratio". The number of a certain kind of dimples which contour line length is minimum in kinds having a specific shape and a dimple number ratio of 5% or more is represented by Ns. The number of a certain kind of dimples which contour line length is maximum in kinds having a specific shape and a dimple number ratio of 5% or more is represented by Nb. In the golf ball, a ratio (Ns/Nb) is 20/80 to 80/20. Consequently, since dimples taking specific shapes having small sizes and dimples taking specific shapes having large sizes are properly mixed, the effect of disturbing an air stream is promoted. From this viewpoint, (Ns/Nb) is preferably 25/75 to 75/25, and more preferably, 30/70 to 70/30.

In the golf ball shown in FIGS. 1 and 2, the number (Ns) of the dimples (B dimples) having a minimum length of the contour line is 102 and the number (Nb) of the dimples (A dimples) having a maximum length of the contour line is 240 in all the kinds of dimples taking specific shapes. Accordingly, (Ns/Nb) is 30/70.

When selecting a kind having a minimum length of a contour line and a kind having a maximum length of a contour line from all the kinds of the dimples taking specific shapes, the kinds of dimples having a ratio of less than 5% to the number of all the dimples is excluded for the following reasons. First of all, the mold of the golf ball is provided with a hold pin in order to hold a core and carry out easy releasing in some cases. Moreover, a vent pin is provided for ventilation from a cavity in some cases. For the design of a dimple pattern or the like, the tips of the pins are convex and the mold is constituted to form a dimple by the tips of the pins in some cases (the dimple will be hereinafter referred to as a "pin tip dimple"). The pin tip dimple takes a specific shape or has a very small size in some cases. Usually, the number of the pin tip dimples is very small, that is, approximately 6 to 14. Accordingly, the pin tip dimple less influences the flight performance of the golf ball. In some cases, moreover, a small number of minimum dimples are provided in order to reduce land portions (on the surface of the golf ball other than the dimples) or a small number of maximum dimples are provided in order to design a dimple pattern. The minimum dimples and the maximum dimples less influence the flight performance of the golf ball because of the small numbers. In the present invention, such a kind as to less influence the flight performance of the golf ball is excluded and the kind of a substantially maximum dimple and the kind of a substantially minimum dimple are selected to calculate (Ns/Nb).

In FIG. 1, P denotes a pole. In the case in which a golf ball is to be formed by a mold including upper and lower parts having hemispherical cavities respectively, the pole P corresponds to a north pole or a south pole with a parting line of the upper and lower parts set to be the equator of a globe. In the plan view of FIG. 1, when the golf ball is rotated at an interval of 120 degrees by setting the pole P as a center, dimple patterns obtained before and after the rotation are completely coincident with each other. In other words, the dimple pattern of the golf ball is rotation symmetrical at an angle of 120 degrees. When a hemisphere is equally divided into three units by the circular arcs of three great circles passing through the pole P, the dimple patterns in the units are identical to each other. More specifically, the unit having the identical dimple pattern repeatedly appears three times in each hemisphere.

The number of repetitions of the unit having the identical dimple pattern is ideally three, and may be four. A dimple pattern repeatedly appearing four times is rotation symmetrical at an angle of 90 degrees. In some cases in which the number of repetitions is two or one, an area occupied by one unit is great and flight symmetry is therefore insufficient. To the contrary, when the number of repetitions is more than five, the unit having the identical dimple pattern often appears by a backspin. Therefore, it is hard to obtain the dimple effect based on the mixture of a circular dimple and a dimple taking a specific shape. A dimple pattern repeatedly appearing five times is rotation symmetrical at an angle of 72 degrees.

The golf ball shown in FIGS. 1 and 2 has twelve specific land portions Ls. The specific land portion Ls is surrounded by five dimples taking a specific shape (the B dimple) arranged at an almost equal center angle pitch (approximately 72 degrees) The dimple effect is promoted by the specific land portion Ls. In particular, it is preferable that the specific land portion Ls having such a size as to draw a circle having a diameter of 1.2 mm should be provided with crossing none of the five surrounding dimples having a specific shape.

An edge line obtained by projecting each side of a regular icosahedron inscribed on a virtual sphere of the ball onto the spherical surface of the virtual sphere of the ball is shown in a two-dotted line of FIGS. 1 and 2. As is apparent from FIGS. 1 and 2, the specific land portion Ls is present in a position corresponding to each apex of the regular icosahedron. More specifically, the twelve specific land portions Ls are provided uniformly (evenly) on the surface of the golf ball. Consequently, the flight symmetry of the golf ball can be enhanced.

The sum of volumes of the dimples is preferably 400 $mm^3$ to 550 $mm^3$, and more preferably, 420 $mm^3$ to 530 $mm^3$. In some cases in which the sum of volumes of the dimples is less than the range, a trajectory becomes too high so that a flight distance is insufficient. In some cases in which the sum of volumes of the dimples is more than the range, the trajectory becomes too low so that the flight distance is insufficient. The volume of the dimple implies a volume of a portion surrounded by the virtual sphere of the ball (shown in a two-dotted line of FIG. 3) and the surface of the dimple.

The total number of the dimples is preferably 350 to 550, and more preferably 400 to 480. In some cases in which the total number of the dimples is less than the range, the trajectory becomes too high so that the flight distance is insufficient. In some cases in which the total number of the dimples is more than the range, the trajectory becomes too low so that the flight distance is insufficient.

Figure 6:
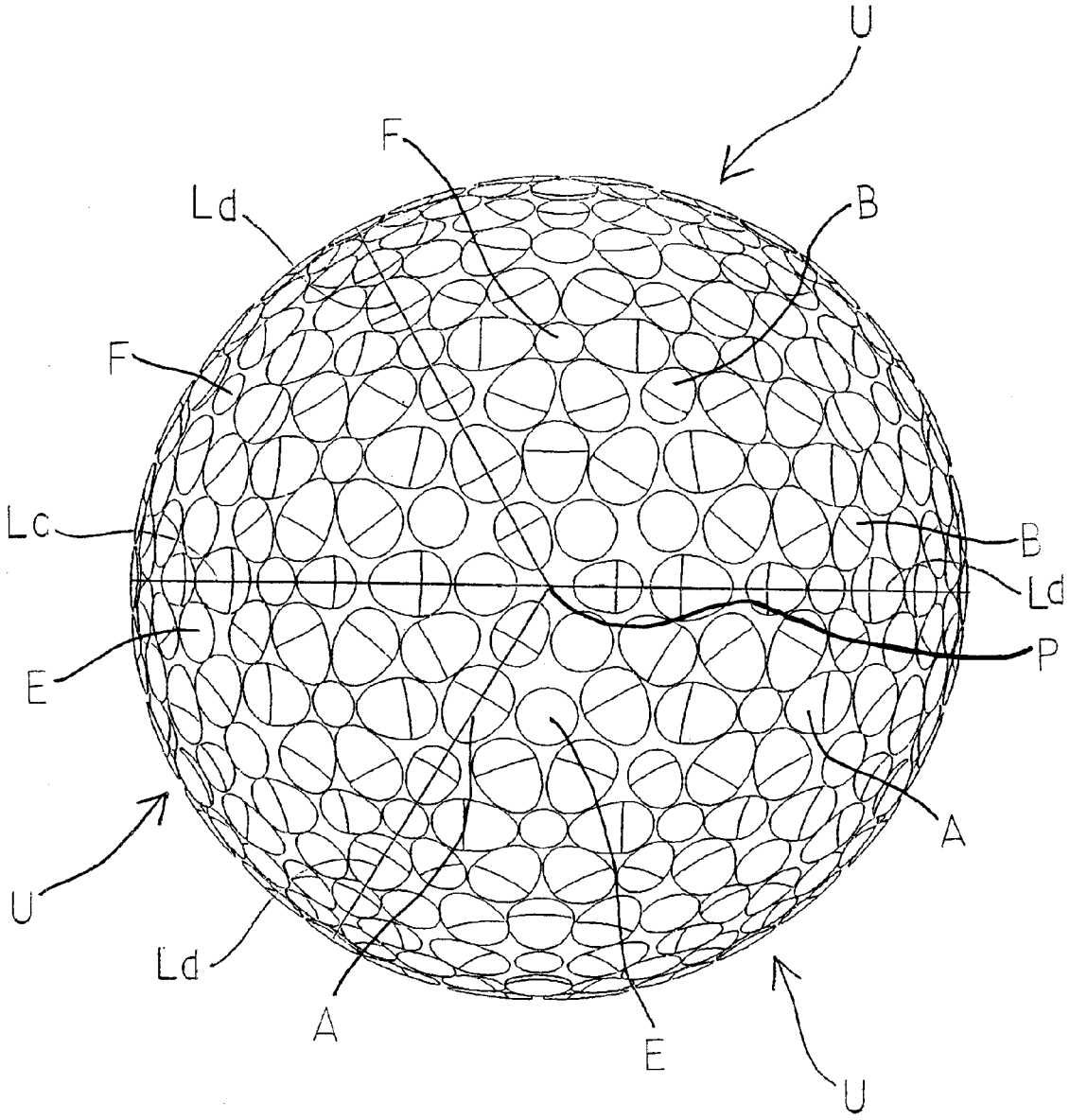
FIG. 6 is a plan view showing a golf ball according to another embodiment of the present invention.
Figure 7:
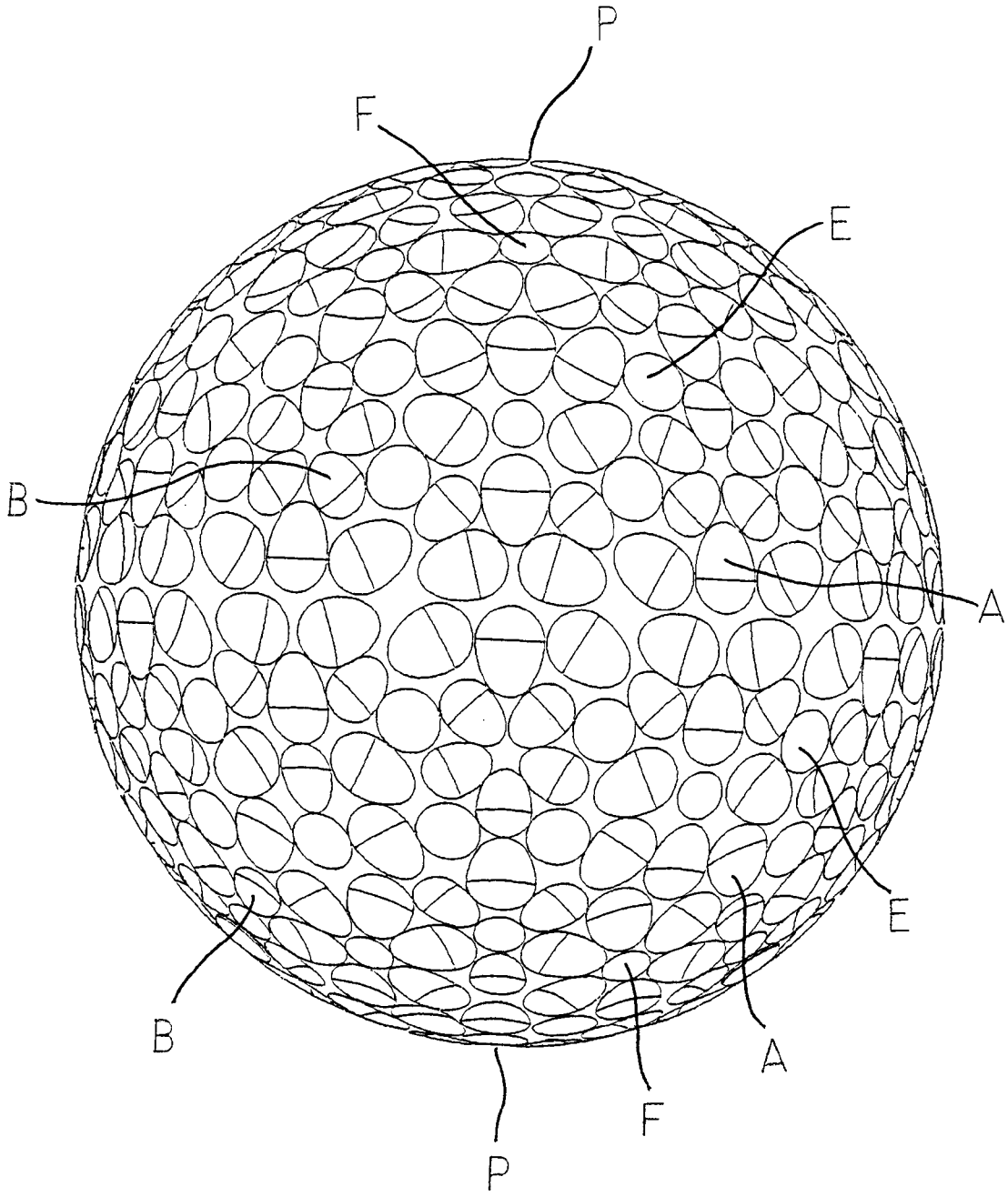
FIG. 7 is a front view showing the golf ball in FIG. 6.

FIG. 6 is a plan view showing a golf ball according to another embodiment of the present invention. Moreover, FIG. 7 is a front view showing the golf ball. The golf ball has four kinds of dimples A, B, E and F. The A and B dimples have the same shapes and dimensions as those of the teardrop-shaped dimple formed on the golf ball shown in FIGS. 1 and 2. The E dimple is a circle having a diameter of 3.20 mm. The F dimple is a circle having a diameter of 2.50 mm. The golf ball has 228 A dimples, 132 B dimples, 66 E dimples and 30 F dimples. The total number of the dimples is 456.

The ratio of the number of the non-circular dimples (that is, 360) to the number of all the dimples (that is, 456) is 78.9%. All the non-circular dimples are teardrop-shaped to take specific shapes. On the other hand, in the golf ball, the ratio of the number of the circular dimples (that is, 96) to the number of all the dimples (that is, 456) is 21.1%. Thus, the dimple effect of the whole golf ball can be enhanced by the mixture of the non-circular dimples (particularly, the dimples taking specific shapes) and the circular dimples.

The golf ball shown in FIGS. 6 and 7 has plural kinds of dimples taking specific shapes (more specifically, two kinds of dimples A and B). By the mixture of plural kinds of dimples taking specific shapes, the effect of disturbing an air stream is promoted. While the boundary line of the semicircular portion and the semielliptic portion is drawn in the teardrop-shaped dimple shown in FIGS. 1 and 2, the boundary line does not appear when both of them are continuously provided smoothly.

In the golf ball shown in FIGS. 6 and 7, the number (Ns) of the dimples (B dimple) having a minimun length of the contour line is 132 and the number (Nb) of the dimples (A dimple) having a maximum length of a contour line is 228 in all kinds of dimples taking specific shapes. Accordingly, (Ns/Nb) is 37/63.

In the plan view of FIG. 6, when the golf ball is rotated around the pole P at an interval of 120 degrees, dimple patterns obtained before and after the rotation are completely coincident with each other. More specifically, the dimple pattern of the golf pattern is rotation symmetrical at an angle of 120 degrees.

The golf ball shown in FIGS. 6 and 7 has twelve specific land portions Ls. By the specific land portions Ls, the dimple effect is promoted. In the golf ball, the specific land portions Ls are provided unevenly over a spherical surface.

Each of three segments Ld shown in FIG. 6 has one of ends positioned on the pole P and is drawn at a center angle pitch of 120 degrees. By the segment Ld, the hemisphere of the golf ball is divided into three units U. As described above, the dimple pattern of the golf ball is rotation symmetrical at an angle of 120 degree. Therefore, the dimple patterns in the units are identical to each other. A segment Lc serves to further divide the unit into two portions. The dimple pattern of the unit is not mirror symmetrical with respect to the segment Lc. In the golf ball, there is no symmetrical surface (appearing as a segment in the drawing) for dividing the dimple pattern of the hemisphere into two portions mirror symmetrically. Accordingly, dimple patterns on both sides of the highest speed portion of a backspin in each hemisphere are not mirror symmetrical with each other. In the golf ball, consequently, the dimple effect can be more enhanced.

EXAMPLES

Example 1

An ionomer resin composition was subjected to injection molding to form a cover around a core made of solid rubber. Thus, a golf ball according to an example 1 having a dimple pattern shown in the plan view of FIG. 1 and the front view of FIG. 2 was obtained. The ball had an outside diameter of 42.70 mm±0.03 mm and a compression of 93±2, and the sum of volumes of dimples was approximately 480 $mm^3$.

Example 2

A golf ball according to an example 2 was obtained in the same manner as in the example 1 except that a mold was changed and the golf ball had a dimple pattern shown in the plan view of FIG. 6 and the front view of FIG. 7.

Comparative Example 1

Figure 8:
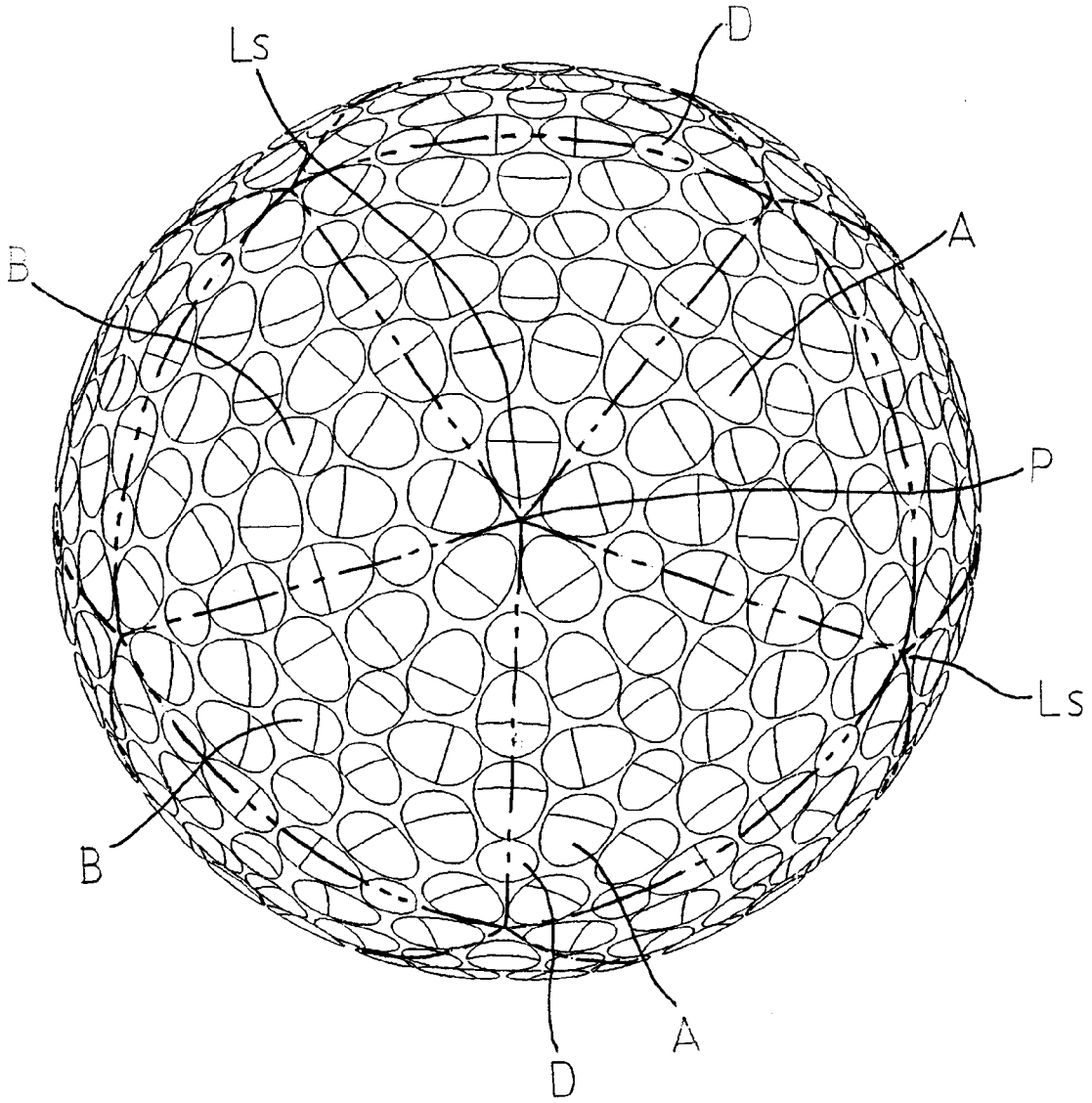
FIG. 8 is a plan view showing a golf ball according to a comparative example 1 of the present invention.
Figure 9:
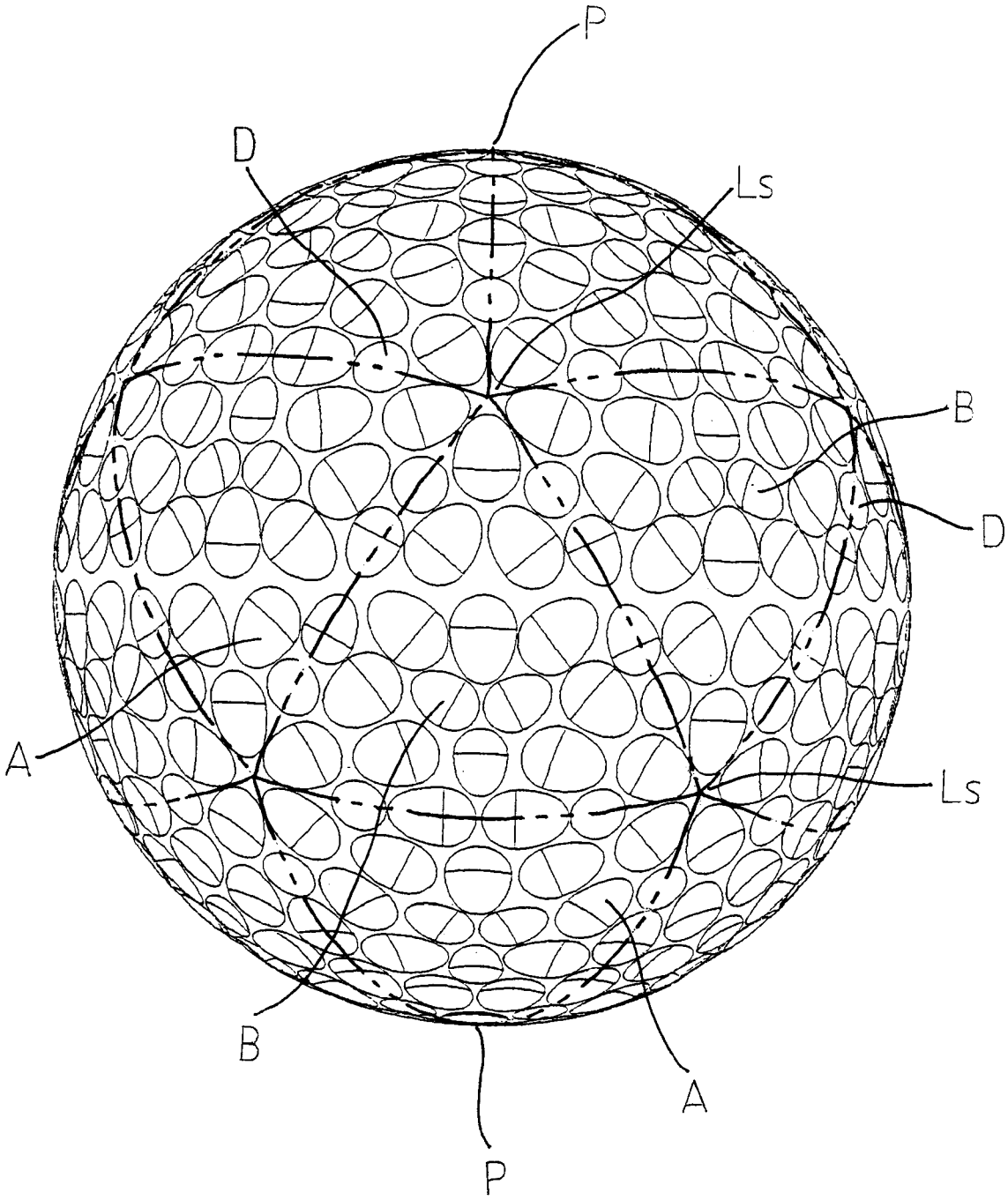
FIG. 9 is a front view showing the golf ball in FIG. 8.

A golf ball according to a comparative example 1 was obtained in the same manner as in the example 1 except that a mold was changed and the golf ball had a dimple pattern shown in the plan view of FIG. 8 and the front view of FIG. 9. The golf ball has 280 A dimples, 80 B dimples and 60 D dimples, and the total number of the dimples is 420. The ratio of non-circular dimples of the golf ball is 85.7%, the ratio of circular dimples is 14.3%, and the ratio of dimples taking specific shapes is 100%. A value of Ns/Nb in the golf ball is 22/78. A dimple pattern in the hemisphere of the golf ball is rotation symmetrical at an angle of 72 degrees and is also mirror symmetrical. The golf ball has twelve specific land portions Ls which are distributed uniformly over a spherical surface.

Comparative Example 2

Figure 10:
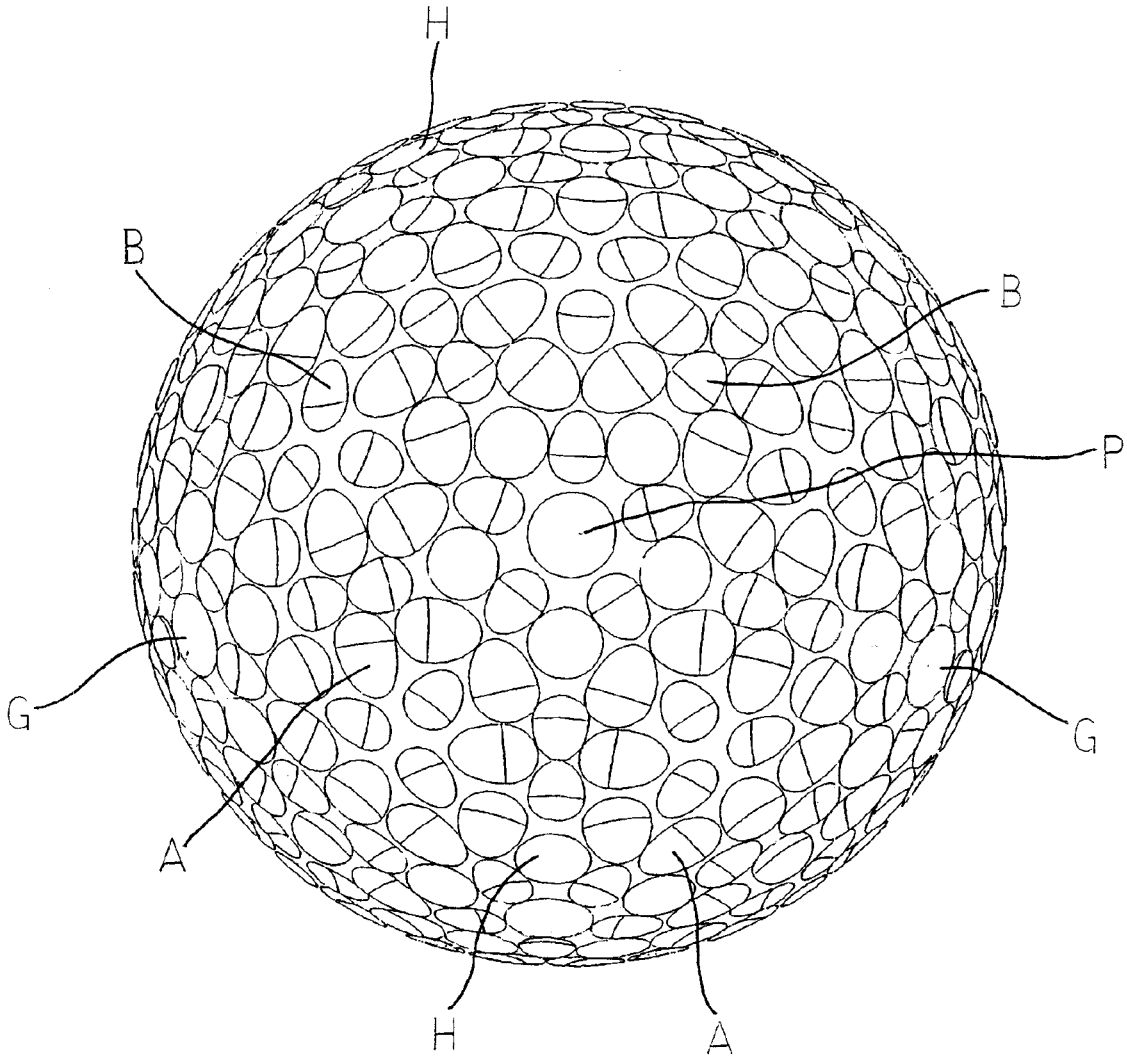
FIG. 10 is a plan view showing a golf ball according to a comparative example 2 of the present invention.
Figure 11:
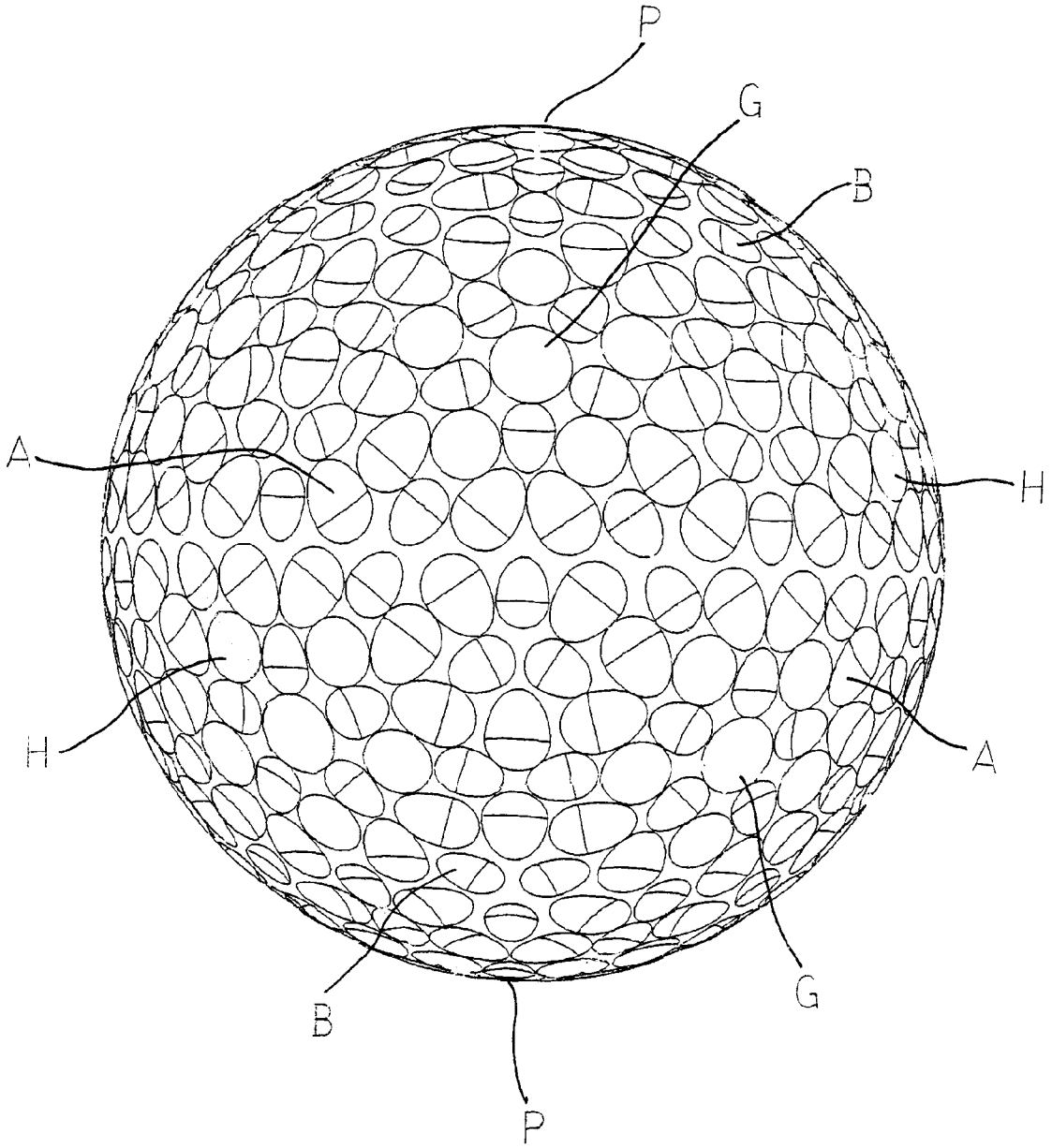
FIG. 11 is a front view showing the golf ball in FIG. 10.

A golf ball according to a comparative example 2 was obtained in the same manner as in the example 1 except that a mold was changed and the golf ball had a dimple pattern shown in the plan view of FIG. 10 and the front view of FIG. 11. The golf ball has 180 A dimples, 180 B dimples, 12 G dimples having a circular contour and a diameter of 4.30 mm, and 60 H dimples having a circular contour and a diameter of 3.65 mm, and the total number of the dimples is 432. The ratio of non-circular dimples of the golf ball is 83.3%, the ratio of circular dimples is 16.7% and the ratio of dimples taking specific shapes is 100%. A value of Ns/Nb in the golf ball is 50/50. A dimple pattern in the hemisphere of the golf ball is rotation symmetrical at an angle of 72 degrees and is also mirror symmetrical. The golf ball does not have a specific land portion.

Comparative Example 3

Figure 12:
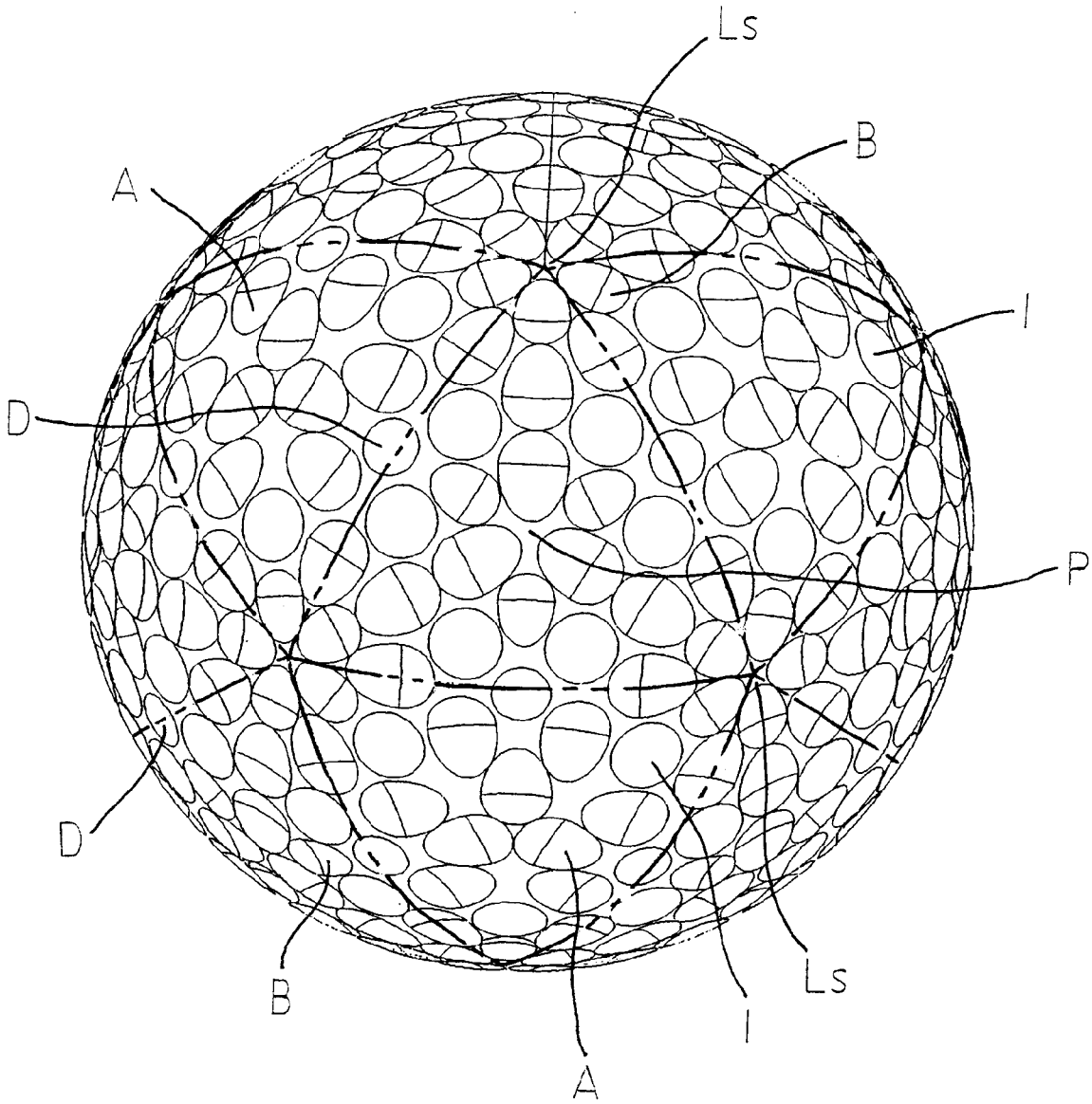
FIG. 12 is a plan view showing a golf ball according to a comparative example 3 of the present invention.
Figure 13:
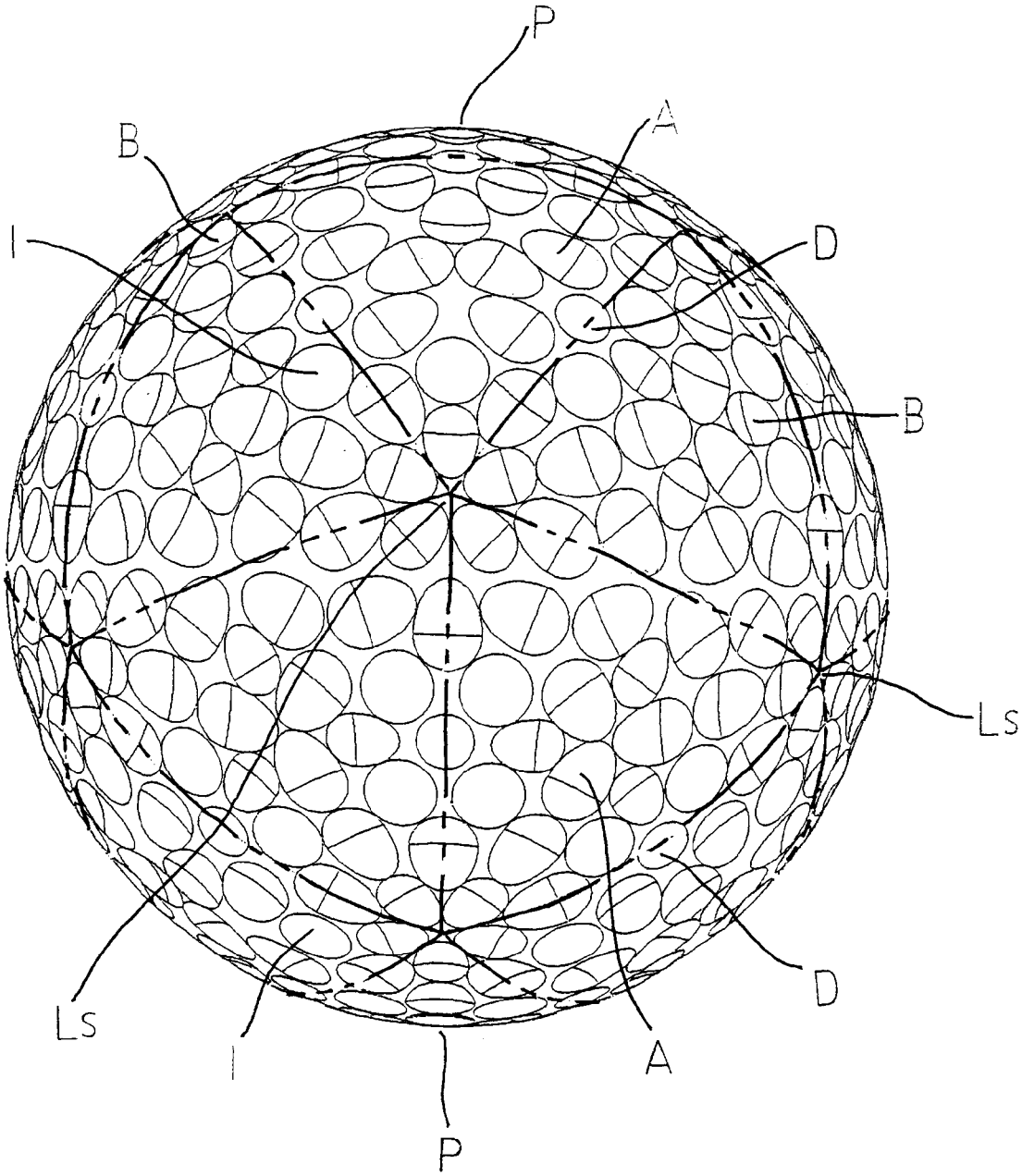
FIG. 13 is a front view showing the golf ball in FIG. 12.

A golf ball according to a comparative example 3 was obtained in the same manner as in the example 1 except that a mold was changed and the golf ball had a dimple pattern shown in the plan view of FIG. 12 and the front view of FIG. 13. The golf ball has 222 A dimples, 102 B dimples, 78 I dimples having a circular contour and a diameter of 3.60 mm and 24 D dimples, and the total number of the dimples is 426. The ratio of non-circular dimples of the golf ball is 76.1%, the ratio of circular dimples is 23.9%, and the ratio of dimples taking specific shapes is 100%. A value of Ns/Nb in the golf ball is 31/69. A dimple pattern in the hemisphere of the golf ball is rotation symmetrical at an angle of 120 degrees and is also mirror symmetrical. The golf ball has twelve specific land portions Ls which are distributed uniformly over a spherical surface.

Comparative Example 4

Figure 14:
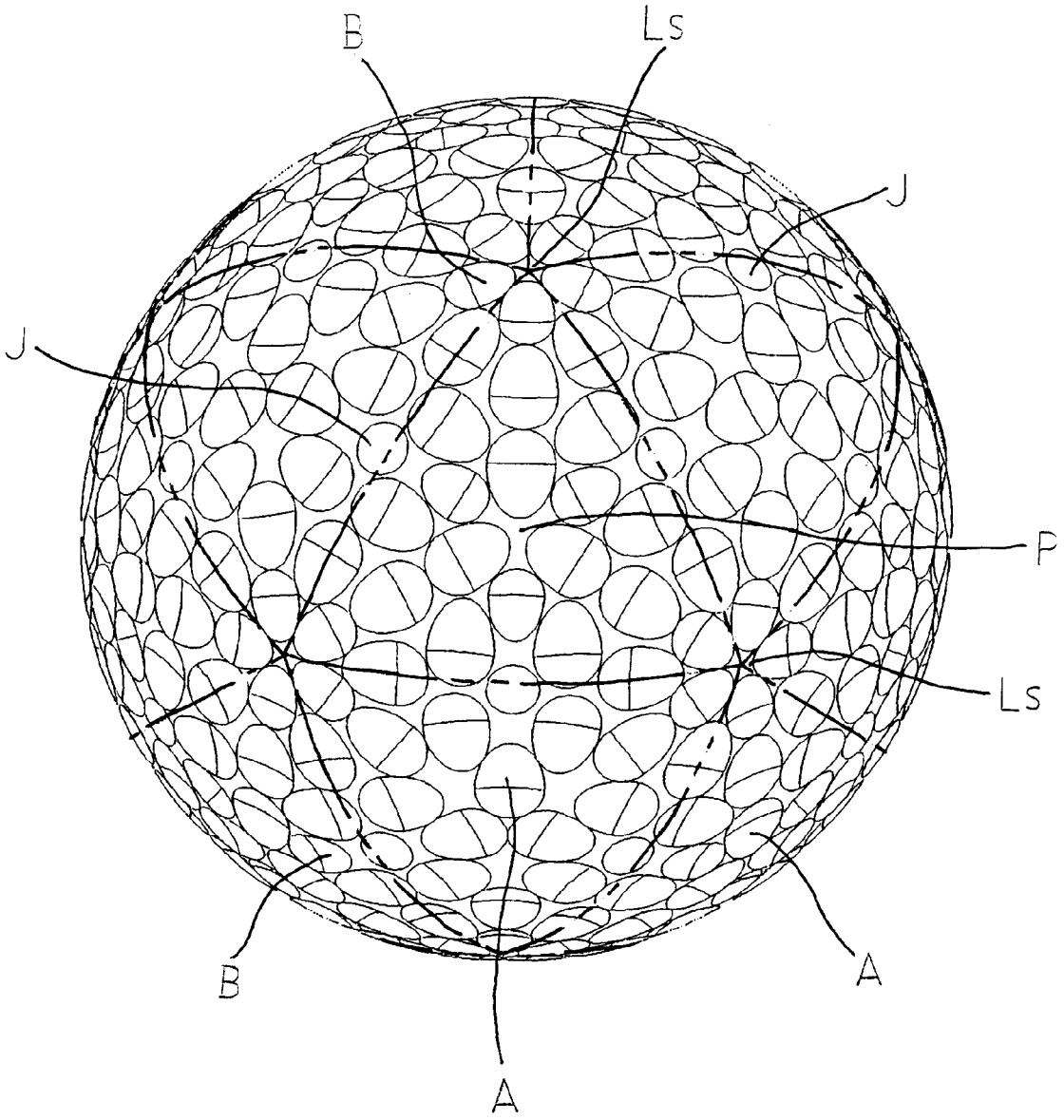
FIG. 14 is a plan view showing a golf ball according to a comparative example 4 of the present invention.
Figure 15:
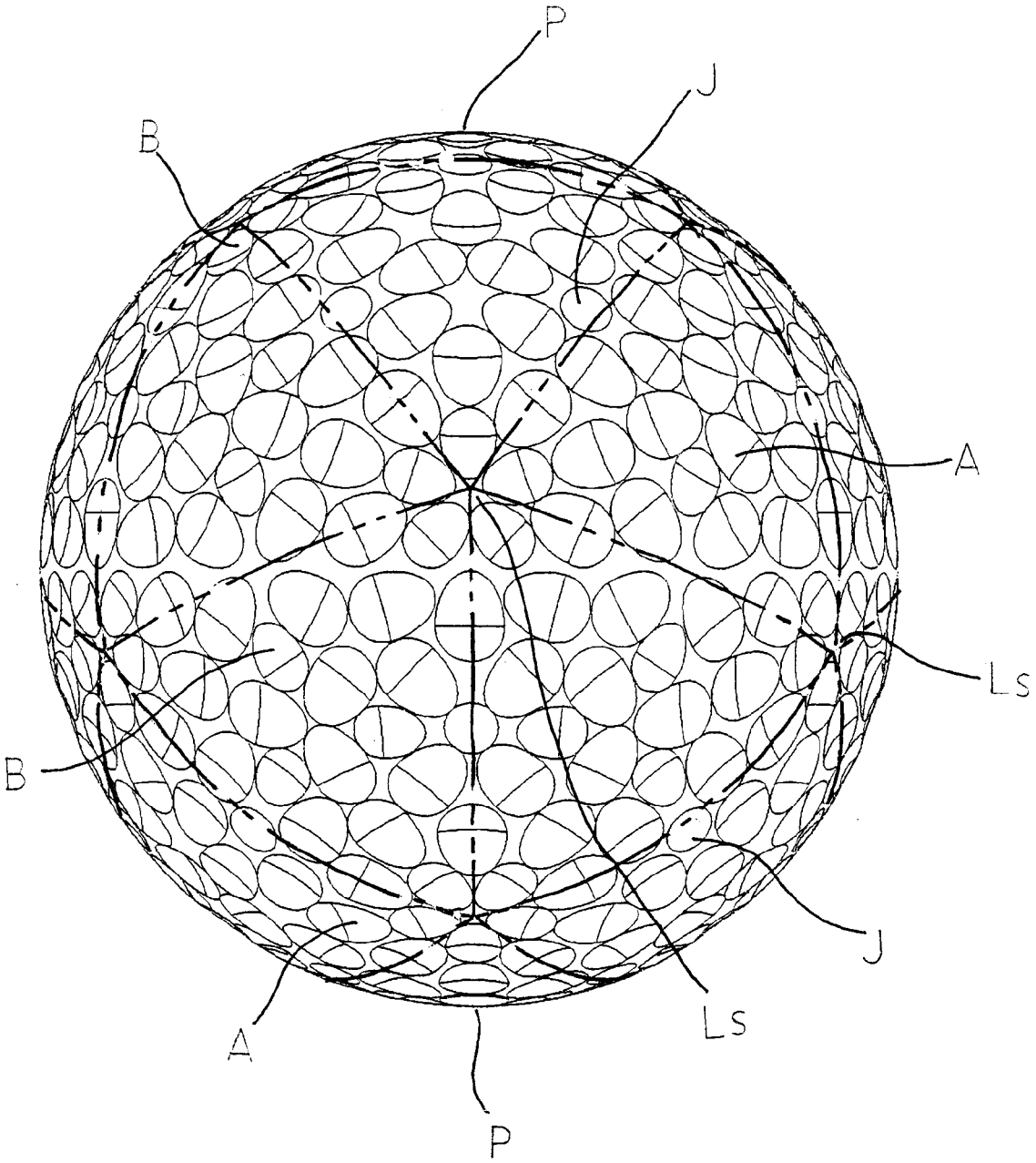
FIG. 15 is a front view showing the golf ball in FIG. 14.

A golf ball according to a comparative example 4 was obtained in the same manner as in the example 1 except that a mold was changed and the golf ball had a dimple pattern shown in the plan view of FIG. 14 and the front view of FIG. 15. The golf ball has 300 A dimples, 102 B dimples and 24 J dimples having a circular contour and a diameter of 2.65 mm, and the total number of the dimples is 426. The ratio of non-circular dimples of the golf ball is 94.4%, the ratio of circular dimples is 5.6%, and the ratio of dimples taking specific shapes is 100%. A value of Ns/Nb in the golf ball is 25/75. A dimple pattern in the hemisphere of the golf ball is rotation symmetrical at an angle of 120 degrees and is also mirror symmetrical. The golf ball has twelve specific land portions Ls which are distributed uniformly over a spherical surface.

[Flight Distance Test]

20 golf balls according to each of the examples and the comparative examples were prepared and maintained at 23° C. On the other hand, a driver (W1) formed of a metal head was attached to a swing machine produced by True Temper Co. and the conditions of the machine were adjusted to set a head speed of approximately 48.8 m/s, a launch angle of approximately 10 degrees and a back spin rate of approximately 3000 rpm. The golf ball was hit to measure a carry (a distance from a shooting point to a drop point) and a total flight distance (a distance from the shooting point to a static point). The mean value of the results of measurement for 20 golf balls is shown in the following Table 1. The test was carried out in an almost windless state.

TABLE 1

Result of evaluation of golf ball

| | Example 1 | Example 2 | Com. Example 1 | Com. Example 2 | Com. Example 3 | Com. Example 4 |
|---|---|---|---|---|---|---|
| Plan View | FIG. 1 | FIG. 6 | FIG. 8 | FIG. 10 | FIG. 12 | FIG. 14 |
| Front View | FIG. 2 | FIG. 7 | FIG. 9 | FIG. 11 | FIG. 13 | FIG. 15 |
| Total number of dimples | 426 | 456 | 420 | 432 | 426 | 426 |
| Teardrop-shaped dimple | A-3.40-240 | A-3.40-228 | A-3.40-280 | A-3.40-180 | A-3.40-222 | A-3.40-300 |
| Kind-minor axis (mm) - number | B-2.75-102 | B-2.75-132 | B-2.75-80 | B-2.75-180 | B-2.75-102 | B-2.75-102 |
| Circular dimple | C-3.40-60 | E-3.20-66 | D-2.85-60 | G-4.30-12 | I-3.60-78 | J-2.65-24 |
| Kind-diameter (mm) - number | D-2.85-24 | F-2.50-30 | | H-3.65-60 | D-2.85-24 | |
| Ratio of nin-circular dimple (%) | 80.3 | 78.9 | 85.7 | 83.3 | 76.1 | 94.4 |
| Ratio of circular dimple (%) | 19.7 | 21.1 | 14.3 | 16.7 | 23.9 | 5.6 |
| Ration of dimple taking specific shape (%) | 100 | 100 | 100 | 100 | 100 | 100 |
| Ns/Nb | 30/70 | 37/63 | 22/78 | 50/50 | 31/69 | 25/75 |
| Rotational symmetry angle in hemisphere (deg.) | 120 | 120 | 72 | 72 | 120 | 120 |
| Mirror symmetry in hemisphere | Yes (x) | No (o) | Yes (x) | Yes (x) | Yes (x) | Yes (x) |
| Specific land portion | | | | | | |
| Number | 12 | 12 | 12 | — | 12 | 12 |
| Deviation of arrangement | Uniform | Non-Uniform | Uniform | — | Uniform | Uniform |
| Sum of volume of dimple ($mm^3$) | 480 | 480 | 480 | 480 | 480 | 480 |
| Carry (m) | 230.4 | 229.8 | 229.2 | 228.9 | 229.0 | 229.2 |
| Total (m) | 247.8 | 247.5 | 246.1 | 246.0 | 245.8 | 245.7 |

In the Table 1, the golf ball according to each of the examples has a greater flight distance than that of the golf ball according to each of the comparative examples.

As described above, the dimple effect of the golf ball can be enhanced by:

(1) a combination of a circular dimple and a non-circular dimple (particularly, a dimple taking a specific shape);

(2) a combination of non-circular dimples having different sizes (particularly, dimples taking specific shapes); and (3) the proper number of repetitions of a dimple pattern in a hemisphere.

Moreover, the dimple effect can further be enhanced by:

(4) non-mirror symmetry of a dimple pattern in a hemisphere; and (5) arrangement of a specific land portion.

The golf ball according to the present invention is excellent in flight performance.

The above description is only illustrative and can be variously changed without departing from the scope of the present invention.

What is claimed is:

1. A golf ball having, on a surface thereof, a large number of non-circular dimples taking planar shapes other than a circle and a large number of circular dimples taking circular planar shapes, wherein a ratio of the number of the non-circular dimples to the number of all dimples is 77% to 92%, a ratio of the number of the circular dimples to the number of all the dimples is 8% to 23%, the non-circular dimples include plural kinds of dimples taking specific shapes to satisfy conditions (A) and (B) which will be described below:

(A) a contour line in a planar shape is formed by a combination of a semicircle and a circular arc or a combination of a semicircle and an elliptic arc; and (B) the contour line does not have a convex portion therein, and a ratio of the total number of the dimples taking specific shapes to all the non-circular dimples is 80% or more, when the number of a certain kind of dimples which contour line length is minimum in kinds having a specific shape and a dimple number ratio of 5% or more is represented by Ns and the number of a certain kind of dimples which contour line length is maximum in kinds having a specific shape and a dimple number ratio of 5% or more is represented by Nb, a ratio (Ns/Nb) is 20/80 to 80/20, and a dimple pattern is rotation symmetrical at an angle of 120 degrees or 90 degrees by setting a pole to be a center of rotation in both of two hemispheres obtained by a division through a parting surface of a mold.

2. The golf ball according to claim 1, wherein the dimple pattern is not mirror symmetrical in both of the two hemispheres obtained by the division through the parting surface of the mold.

3. The golf ball according to claim 1, wherein the surface is provided with twelve or more specific land portions surrounded by five dimples taking a specific shape which are arranged at a substantially equal center angle pitch.

4. The golf ball according to claim 3, wherein the specific land portion is provided uniformly on a surface.

5. The golf ball according to claim 1, wherein a sum of volumes of dimples in a portion surrounded by a virtual sphere of the ball and surfaces of the dimples is 400 $mm^3$ to 550 $mm^3$.

* * * * *